US008557753B2

(12) United States Patent
Gieselman et al.

(10) Patent No.: US 8,557,753 B2
(45) **Date of Patent: *Oct. 15, 2013**

(54) LUBRICATING COMPOSITION CONTAINING A FUNCTIONALIZED CARBOXYLIC POLYMER

(75) Inventors: Matthew D. Gieselman, Wickliffe, OH (US); Adam J. Preston, Willoughby, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 20 days.

This patent is subject to a terminal disclaimer.

(21) Appl. No.: 13/130,638

(22) PCT Filed: Nov. 23, 2009

(86) PCT No.: PCT/US2009/065452

§ 371 (c)(1),
(2), (4) Date: Jul. 21, 2011

(87) PCT Pub. No.: WO2010/062842

PCT Pub. Date: Jun. 3, 2010

(65) Prior Publication Data

US 2011/0306528 A1 Dec. 15, 2011

Related U.S. Application Data

(60) Provisional application No. 61/118,012, filed on Nov. 26, 2008.

(51) Int. Cl.
*C10M 159/12* (2006.01)

(52) U.S. Cl.
USPC ..... 508/454; 508/543

(58) Field of Classification Search
USPC ..... 508/454, 543
See application file for complete search history.

(56) References Cited

U.S. PATENT DOCUMENTS

| | | | | |
|---|---|---|---|---|
| 4,161,475 | A | 7/1979 | Davis | |
| 4,234,435 | A | 11/1980 | Meinhardt et al. | |
| 4,863,623 | A | 9/1989 | Nalesnik | |
| 5,182,041 | A | 1/1993 | Benfarmeo et al. | |
| 5,264,140 | A | 11/1993 | Mishra et al. | |
| 5,356,999 | A | 10/1994 | Kapuscinski et al. | |
| 5,409,623 | A | 4/1995 | Mishra et al. | |
| 6,107,257 | A | 8/2000 | Valcho et al. | |
| 6,107,258 | A * | 8/2000 | Esche et al. | 508/231 |
| 6,117,825 | A | 9/2000 | Liu et al. | |
| 7,361,629 | B2 | 4/2008 | Loper et al. | |
| 2005/0202980 | A1 * | 9/2005 | Loper et al. | 508/232 |
| 2008/0171678 | A1 | 7/2008 | Loper et al. | |
| 2010/0298185 | A1 | 11/2010 | Gieselman et al. | |

FOREIGN PATENT DOCUMENTS

| | | |
|---|---|---|
| EP | 0470698 | 12/1992 |
| EP | 1574559 | 9/2005 |
| EP | 1655311 | 5/2006 |
| GB | 768701 | 2/1957 |
| WO | 2006015130 | 2/2006 |

OTHER PUBLICATIONS

Corresponding PCT Publication No. WO 2010/062842 A1 and Search Report published Jun. 3, 2010.
Written Opinion of corresponding International Appln. No. PCT/US2009/065452 mailed Apr. 9, 2010.

* cited by examiner

*Primary Examiner* — Taiwo Oladapo
(74) *Attorney, Agent, or Firm* — Michael F. Esposito, Esq.; David M. Shold, Esq.

(57) ABSTRACT

The invention provides a lubricating composition comprising an oil of lubricating viscosity and an amine-functionalised additive, wherein the amine-functionalised additive is derived from an amine having at least 3 aromatic groups, at least one —NH2 functional group, and at least 2 secondary or tertiary amino groups. The invention further provides for the additive to have dispersant and/or dispersant viscosity modifying properties. The lubricating composition is suitable for lubricating an internal combustion engine.

11 Claims, No Drawings

LUBRICATING COMPOSITION CONTAINING A FUNCTIONALIZED CARBOXYLIC POLYMER

FIELD OF INVENTION

The invention provides a lubricating composition comprising an oil of lubricating viscosity and an amine-functionalised additive, wherein the amine-functionalised additive is derived from an amine having at least 3 aromatic groups, at least one —$NH_2$ functional group, and at least 2 secondary or tertiary amino groups. The invention further provides for the additive to have dispersant and/or dispersant viscosity modifying properties. The lubricating composition is suitable for lubricating an internal combustion engine.

BACKGROUND OF THE INVENTION

Engine manufacturers have focused on improving engine design in order to minimise emissions of particulate emissions, emissions of other pollutants, cleanliness and also improve fuel economy and efficiency. One of the improvements in engine design is the use of exhaust gas recirculation (EGR) engines. Whilst improvements in engine design and operation have contributed to reducing emissions, some engine designs advances are believed to have generated other challenges for the lubricant. For example, EGR is believed to have led to increased formation and/or accumulation of soot and sludge.

Increased soot-mediated oil thickening is common in heavy duty diesel engines. Some diesel engines employ EGR. The soot formed in an EGR engine has different structures and causes increased viscosity of engine lubricant at lower soot levels than formation of soot in the engine without an EGR. Attempts to alleviate soot-mediated oil thickening are disclosed in the references summarised below.

Traditional dispersant viscosity modifiers (DVMs) made from ethylene-propylene copolymers that have been radically grafted with maleic anhydride and reacted with various amines have shown desirable performance to prevent oil thickening in diesel engines. Aromatic amines are said to show good performance in this regard. DVMs of this type are disclosed in, for instance, U.S. Pat. Nos. 4,863,623; 6,107,257; 6,107,258; and 6,117,825.

U.S. Pat. No. 4,863,623 discloses controlling EGR soot by utilising maleic anhydride grafted ethylene-propylene copolymers capped with aromatic amines, such as 4-aminodiphenylamine.

U.S. Pat. No. 5,409,623 discloses functionalised graft copolymers as viscosity index improvers, containing an ethylene alpha-monoolefin copolymer grafted with an ethylenically unsaturated carboxylic acid material and derivatised with an azo-containing aromatic amine compound.

U.S. Pat. No. 5,356,999 discloses multifunctional viscosity index improvers for lubricating oils containing a polymer onto which has been grafted an unsaturated reactive monomer and thereafter reacted with amines containing sulphonamide units. The polymer is either an ethylene-propylene copolymer or an ethylene-propylene-diene terpolymer.

U.S. Pat. No. 5,264,140 discloses an ethylene alpha-monoolefin copolymer grafted with an ethylenically unsaturated carboxylic acid derivatised with an amide-containing aromatic amine material.

International publication WO 06/015130 discloses maleic anhydride grafted ethylene-propylene copolymers capped with sulphonamides, nitroanilines, diaromatic diazocompounds, anilides or phenoxyanilides. The copolymers are useful for controlling EGR soot.

Other dispersant viscosity modifying polymers suitable for lubricants have been contemplated including polyacrylic copolymers, including the disclosure of British Patent GB 768 701.

U.S. Pat. No. 4,234,435 discloses a composition in which a succinated polybutene is condensed with either an alkyl polyamine to make a succinimide dispersant or an alkyl polyol to make a succinic ester dispersant.

U.S. Pat. No. 5,182,041 discloses an additive composition comprising a graft and amine-derivatised polymer having an average molecular weight ranging from about 300 to 3500 which has been reacted with at least one olefinic carboxylic acid acylating agent to form one or more acylating reaction intermediates characterised by having a carboxylic acid acylating function within their structure and reacting said reaction intermediate with an amino-aromatic polyamine compound from the group consisting of an N-arylphenylenediamine, an aminothiazole, an aminocarbazole, an amino-indazolinone, an amino-mercaptotriazole and an aminopyrimidine to form said graft and amine-derivatised copolymer.

U.S. Pat. No. 7,361,629 and US Patent Application 2008/0171678 both disclose an amination product of a hydrocarbyl substituted succinic acylating agent and a mixture containing an aliphatic polyamine and an aromatic polyamine. The molar ratio of aliphatic polyamine to aromatic polyamine in the mixture ranges from about 10:0.1 to about 0.1:10.

U.S. Patent Application 60/987,499, now US Publication 2010/0298185, Gieselman et al., Nov. 25, 2010, discloses an additive obtainable by a process of (1) reacting an anthranilic anhydride with either: (i) an amine, wherein the amine contains a primary or secondary amino-group; (ii) an alcohol; (iii) an aminoalcohol; or (iv) a thiol, to form a product; and (2) reacting the product of (1) with a polymer containing either: (i) an anhydride group; (ii) a carboxylic acid group; or (iii) an acyl group, to form the additive.

SUMMARY OF THE INVENTION

The inventors of the present invention have discovered that providing at least one of (i) a lubricating composition capable of reducing viscosity increase (often having a viscosity of less than 12 $mm^2$/sec (cSt) at 100° C. at a soot loading of 6 weight % or more), and/or (ii) a lubricating oil composition that maintains a relatively stable viscosity over a wide range of temperatures could be desirable because viscosity index improvers or DVMs may be employed to control viscosity over a wide temperature range and to control soot. Accordingly, it may also be desirable if a viscosity index improver were capable of achieving (i) and (ii).

The inventors of this invention have discovered that the lubricating composition is capable of providing at least one of (i) dispersancy, (ii) cleanliness and (iii) providing a lubricant with acceptable levels of soot-mediated oil thickening and/or sludge formation. Accordingly, it may also be desirable if an additive were capable for providing dispersant properties, and optionally providing a lubricant with acceptable levels of soot-mediated oil thickening and/or sludge formation.

In one embodiment the invention provides a lubricating composition comprising an oil of lubricating viscosity and an amine-functionalised additive, wherein the amine-functionalised additive is derived from an amine having at least 3 aromatic groups (or at least 4 aromatic groups), at least one —$NH_2$ functional group, and at least 2 secondary or tertiary amino groups.

In one embodiment the invention provides a lubricating composition comprising an oil of lubricating viscosity and a product obtained/obtainable by reacting a carboxylic functionalised polymer with an amine having at least 3 aromatic groups (or at least 4 aromatic groups), at least one —$NH_2$ functional group, and at least 2 secondary or tertiary amino groups.

In one embodiment the invention provides a lubricating composition comprising an oil of lubricating viscosity and a product obtained/obtainable by reacting a carboxylic acid (such as a fatty acid) with an amine having at least 3 aromatic groups (or at least 4 aromatic groups), at least one —$NH_2$ functional group, and at least 2 secondary or tertiary amino groups.

The fatty acid may include dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene, polypropenyl-substituted succinic acid derived from a polypropene, octadecyl-substituted adipic acid, chlorostearic acid, 12-hydroxystearic acid, 9-methylstearic acid, dichlorostearic acid, ricinoleic acid, lesquerellic acid, stearylbenzoic acid, eicosanyl-substituted naphthoic acid, dilauryldecahydronaphthalene carboxylic acid, 2-propylheptanoic acid, 2-butyloctanoic acid or mixtures thereof. In one embodiment the carboxylic acid may be dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid or mixtures thereof.

In one embodiment the invention provides a lubricating composition comprising an oil of lubricating viscosity and an amine functionalised additive is derived from an amine having at least 3 aromatic groups (or at least 4 aromatic groups), at least one —$NH_2$ functional group, and at, least 2 secondary or tertiary amino groups where the —$NH_2$ group is condensed with a hydrocarbyl-substituted phenol, (typically an alkylphenol) and an aldehyde in a Mannich reaction to make a covalent attachment of the amine to the hydrocarbyl-substituted phenol.

In one embodiment the invention provides a method of lubricating an internal combustion engine comprising, supplying to the internal combustion engine a lubricating composition comprising an oil of lubricating viscosity and an amine-functionalised additive, wherein the amine-functionalised additive is derived from an amine having at least 3 aromatic groups (or at least 4 aromatic groups), at least one —$NH_2$ functional group, and at least 2 secondary or tertiary amino groups.

In one embodiment the invention provides a method of lubricating an internal combustion engine comprising, supplying to the internal combustion engine a lubricating composition an oil of lubricating viscosity and a product obtained/obtainable by reacting a carboxylic functionalised polymer with an amine having at least 3 aromatic groups (or at least 4 aromatic groups), at least one —$NH_2$ functional group, and at least 2 secondary or tertiary amino groups.

In one embodiment the invention provides for the use of the product obtained/obtainable by reacting a carboxylic functionalised polymer with an amine having at least 3 aromatic groups (or at least 4 aromatic groups), at least one —$NH_2$ functional group, and at least 2 secondary or tertiary amino groups as a dispersant or dispersant viscosity modifier in a lubricant.

In one embodiment the invention provides for the use of the product obtained/obtainable by reacting a carboxylic functionalised polymer with an amine having at least 3 aromatic groups (or at least 4 aromatic groups), at least one —$NH_2$ functional group, and at least 2 secondary or tertiary amino groups as a dispersant or dispersant viscosity modifier in an internal combustion engine lubricant.

In one embodiment the invention provides a method for reducing soot-mediated oil thickening in an engine lubricant, comprising including in said lubricant an amine-functionalised additive, wherein the amine-functionalised additive is derived from an amine having at least 3 aromatic groups (or at least 4 aromatic groups), at least one —$NH_2$ functional group, and at least 2 secondary or tertiary amino groups.

DETAILED DESCRIPTION OF THE INVENTION

The present invention provides a lubricating composition and a method for lubricating an engine as disclosed above.

As used herein the term "an aromatic group" is used in the ordinary sense of the term and is known to be defined by Hückel theory of $4n+2\pi$ electrons per ring system. Accordingly, one aromatic group of the invention may have 6, or 10, or $14\pi$ electrons. Hence a benzene ring as $6\pi$ electrons, a naphthylene ring has $10\pi$ electrons and an acridine group has $14\pi$ electrons.

In one embodiment the product may be obtained/obtainable by reacting a carboxylic functionalised polymer with an amine having at least 4 aromatic groups, at least one —$NH_2$ functional group, and at least 2 secondary or tertiary amino groups.

The amine having at least 3 aromatic groups, at least one —$NH_2$ functional group, and at least 2 secondary or tertiary amino groups may be represented by Formula (1):

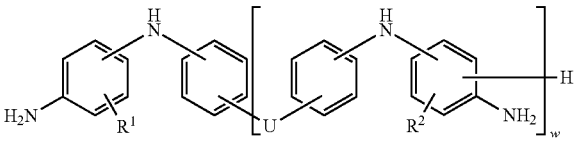

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

The amine having at least 3 aromatic groups, at least one —$NH_2$ functional group, and at least 2 secondary or tertiary amino groups may be represented by Formula (1a):

Formula (1a)

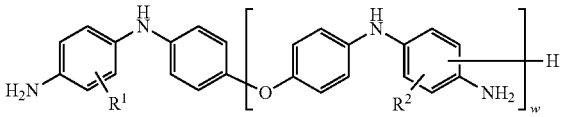

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

Alternatively, the compound of Formula (1a) may also be represented by:

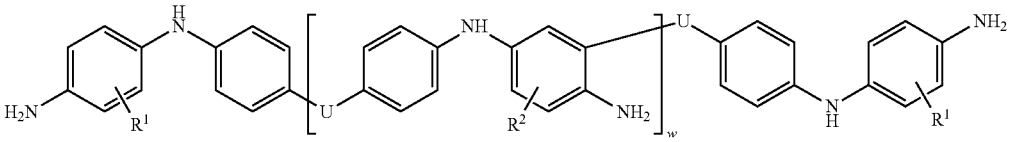

wherein each variable U, $R^1$, and $R^2$ are the same as described above and w is 0 to 9 or 0 to 3 or 0 to 1 (typically 0).

Examples of an amine having at least 3 aromatic groups may be represented by any of the following Formulae (2) and/or (3):

Formula (2)

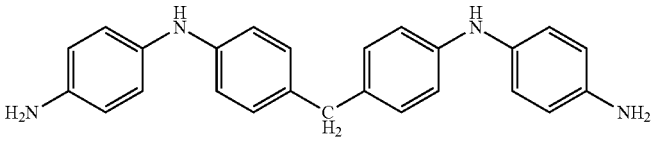

or

Formula (3)

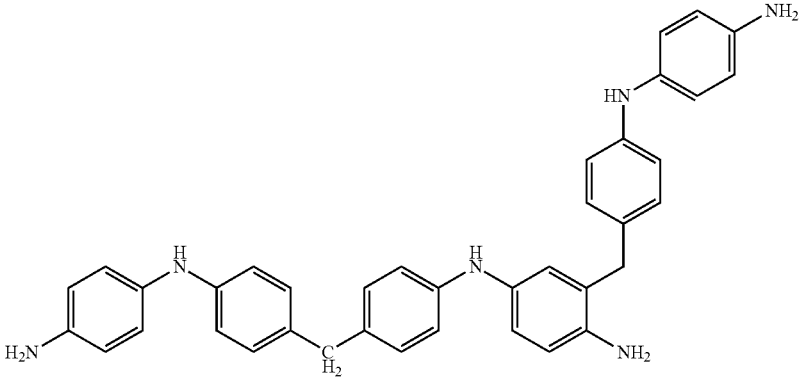

In one embodiment the amine having at least 3 aromatic groups may include mixtures of compounds represented by the formulae disclosed above. A person skilled in the art will appreciate that compounds of Formulae (2) and (3) may also react with the aldehyde described below to form acridine derivatives. Acridine derivatives that may be formed include compounds illustrated represented by Formula (2a) or (3a) below. In addition to these compounds represented these formulae, a person skilled in the art will also appreciate that other acridine structures may be possible where the aldehyde reacts with other benzyl groups bridged with the >NH group. Examples of acridine structures include those represented by Formulae (2a) and (3a):

Formula (2a)

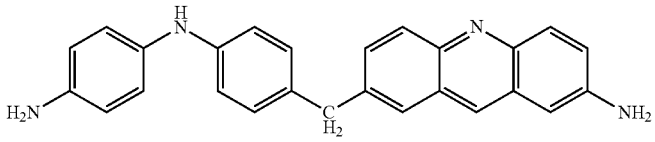

Formula (3a)

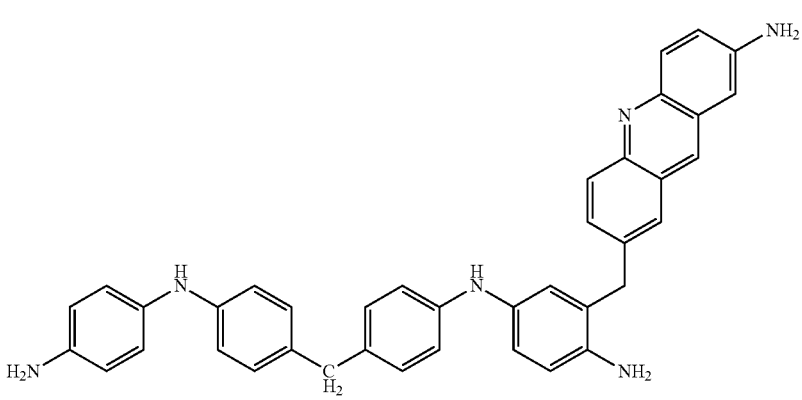

Any or all of the N-bridged aromatic rings are capable of such further condensation and perhaps aromaticisation. One other of many possible structures is shown in Formula (3b).

Formula (3b)

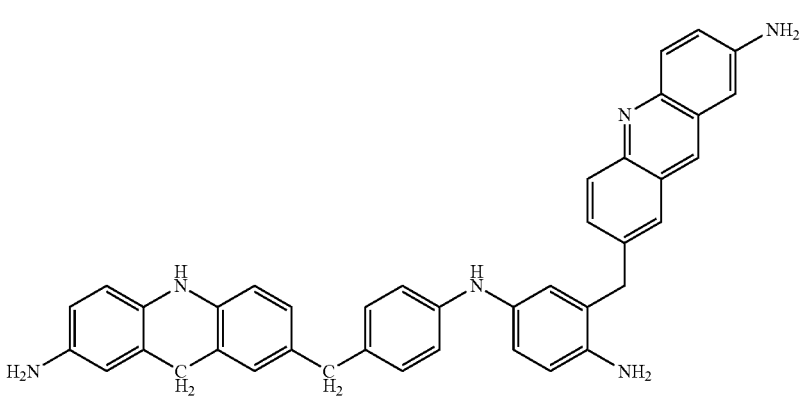

Examples of the amine having at least 3 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine, $N^4$-{4-[4-(4-amino-phenylamino)-benzyl]-phenyl}-2-[4-(4-amino-phenylamino)-cyclohexa-1,5-dienylmethyl]-benzene-1,4-diamine, N-[4-(7-amino-acridin-2-ylmethyl)-phenyl]-benzene-1,4-diamine, or mixtures thereof.

In one embodiment the amine having at least 3 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine or mixtures thereof.

The amine having at least 3 aromatic groups may be prepared by a process comprising reacting an aldehyde with an amine (typically 4-aminodiphenylamine). The resultant amine may be described as an alkylene coupled amine having at least 3 aromatic groups, at least one —$NH_2$ functional group, and at least 2 secondary or tertiary amino groups.

The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde.

The process may be carried out at a reaction temperature in the range of 40° C. to 180° C., or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, or mixtures thereof.

The reaction may be preformed in either air or an inert atmosphere. Examples of suitable inert atmosphere include nitrogen or argon, typically nitrogen.

Alternatively, the amine having at least 3 aromatic groups may also be prepared by the methodology described in Berichte der Deutschen Chemischen Gesellschaft (1910), 43, 728-39.

Carboxylic Functionalised Polymer

The additive which is functionalised with an amine may be a carboxylic functionalised polymer. The carboxylic functionalised polymer backbone may be a homopolymer or a copolymer, provided that it contains at least one carboxylic acid functionality or a reactive equivalent of carboxylic acid functionality (e.g., anhydride or ester). The carboxylic functionalised polymer has a carboxylic acid functionality (or a reactive equivalent of carboxylic acid functionality) grafted onto the backbone, within the polymer backbone or as a terminal group on the polymer backbone.

The carboxylic functionalised polymer may be a polyisobutylene-succinic anhydride polymer, a maleic anhydride-styrene copolymer, an ester of a maleic anhydride-styrene copolymer, an alpha olefin-maleic anhydride copolymer, or a maleic anhydride graft copolymer of (i) a styrene-ethylene-alpha olefin polymer, (ii) a hydrogenated alkenyl aryl conjugated diene copolymer (that is, a hydrogenated alkenyl arene conjugated diene copolymer, in particular a hydrogenated copolymer of styrene-butadiene), (iii) a polyolefin (in particular ethylene-propylene copolymer), or (iv) a hydrogenated isoprene polymer (in particular isobutylene-isoprene copolymer or a hydrogenated styrene-isoprene polymer), or mixtures thereof.

The carboxylic functionalised polymer described herein is known in lubricant technology. For example:

(i) esters of maleic anhydride and styrene-containing polymers are known from U.S. Pat. No. 6,544,935;

(ii) grafted styrene-ethylene-alpha olefin polymers are taught in International publication WO 01/30947;

(iii) copolymers derived from isobutylene and isoprene have been used in preparing dispersants and are reported in International publication WO 01/98387;

(iv) grafted styrene-butadiene and styrene-isoprene copolymers are described in a number of references including DE 3,106,959; and U.S. Pat. Nos. 5,512,192, and 5,429,758;

(v) polyisobutylene succinic anhydrides have been described in numerous publications including U.S. Pat. Nos. 4,234,435; 3,172,892; 3,215,707; 3,361,673; and 3,401,118;

(vi) grafted ethylene-propylene copolymers have been described in U.S. Pat. Nos. 4,632,769; 4,517,104; and 4,780,228;

(vii) esters of (alpha-olefin maleic anhydride) copolymers have been described in U.S. Pat. No. 5,670,462;

(viii) copolymers of isobutylene and conjugated dienes (such as isobutylene-isoprene copolymer) have been described in U.S. Pat. Nos. 7,067,594 and 7,067,594 and US Patent Application US 2007/0293409; and (ix) terpolymers of ethylene, propylene and non-conjugated diene (such as dicyclopentadiene or butadiene) and described in U.S. Pat. Nos. 5,798,420 and 5,538,651.

Many of the polymer backbones are also described in "Chemistry and Technology of Lubricants, Second Edition, Edited by R. M. Mortier and S. T. Orszulik Published by Blackie Academic & Professional. In particular pages 144-180 discuss many of the polymer backbones (i)-(iv) and (vi)-(viii).

The polymer backbone (other than a polyisobutylene) of the present invention may have a number average molecular weight (by gel permeation chromatography, polystyrene standard), which may be up to 150,000 or higher, e.g., 1,000 or 5,000 to 150,000 or to 120,000 or to 100,000. An example of a suitable number average molecular weight range includes 10,000 to 50,000, or 6,000 to 15,000, or 30,000 to 50,000. In one embodiment, the polymer backbone has a number average molecular weight of greater than 5,000, for instance, greater than 5000 to 150,000. Other combinations of the above-identified molecular weight limitations are also contemplated.

When the polymer backbone of the invention is a polyisobutylene, its number average molecular weight (by gel permeation chromatography, polystyrene standard), may be 350 to 5000, or 550 to 3000 or 750 to 2500. (Thus, a polyisobutylene succinic anhydride may have, that is, be derived from, a polyisobutylene with any of the foregoing molecular weights.) Commercially available polyisobutylene polymers have a number average molecular weight of 550, 750, 950-1000, 1550, 2000, or 2250. Some of the commercially available polyisobutylene polymers may obtain the number average molecular weights shown above by blending one or more polyisobutylene polymers of different weights.

The amine having at least 3 aromatic groups may be reacted with the carboxylic functionalised polymer under known reaction conditions. The reaction conditions are known to a person skilled in the art for forming imides and/or amides of carboxylic functionalised polymers.

The invention product obtained/obtainable by reacting a carboxylic functionalised polymer with an amine having at least 3 aromatic groups, at least one —$NH_2$ functional group, and at least 2 secondary or tertiary amino groups may be represented by the Formulae (4) and/or (5):

Formula (4)

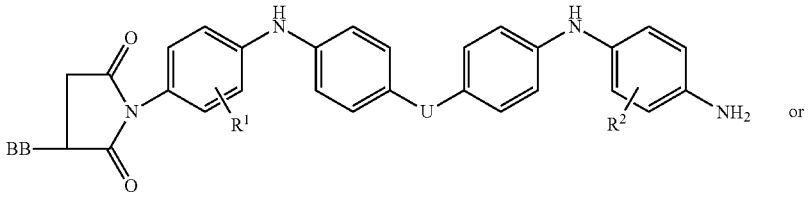

or

-continued

Formula (5)

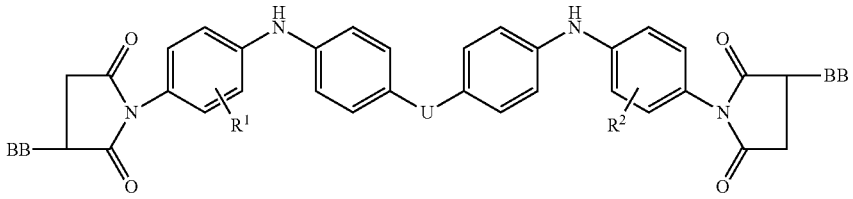

wherein independently each variable, $R^1$, $R^2$ and U are described previously;

BB is a polymer backbone and may be polyisobutylene, or copolymers of (i) hydrogenated alkenyl aryl conjugated diene copolymers (in particular hydrogenated copolymers of styrene-butadiene), (ii) polyolefins (in particular ethylene-alphaolefins such as ethylene-propylene copolymers), or (iii) hydrogenated isoprene polymers (in particular hydrogenated styrene-isoprene polymers). BB may be substituted with one succinimide group as is shown in formulae (4) and (5), or it may be substituted by multiple succinimide groups.

In addition to formulae (4) and (5), additional structures may also be formed including trimers, tetramers, higher-mers or mixtures thereof. The amino groups shown in Formulae (4) and (5) may also be replaced, in whole or in part, by the amine of formula (3), or mixtures thereof.

When BB is polyisobutylene the resultant carboxylic functionalised polymer may typically be polyisobutylene succinic anhydride. Typically w, as defined in Formula (1) may be 1 to 5, or 1 to 3.

When BB is other than polyisobutylene, and has maleic anhydride (or other carboxylic acid functionality) grafted thereon, one or more of the grafted maleic anhydride groups is a succinimide of the amine of the invention. The number of succinimide groups may be 1 to 40, or 2 to 40, or 3 to 20.

The invention product is obtained/obtainable by reacting a carboxylic functionalised polymer derived from maleic anhydride-styrene copolymers, esters of maleic anhydride-styrene copolymers, (alpha-olefin maleic anhydride) copolymers; or mixtures thereof with an amine having at least 3 aromatic groups, at least one —$NH_2$ functional group, and at least 2 secondary or tertiary amino groups. The resultant product may be represented by Formula (6):

Formula (6)

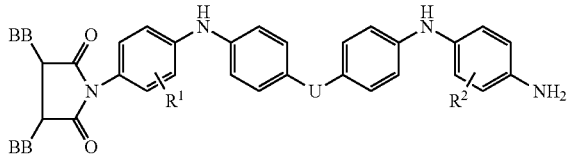

wherein $R^1$, $R^2$ and U are described previously;

BB may be a styrene-containing polymer chain that may contain additional succinimide groups.

Formula (6) may also replace the amine containing group shown in Formula (6) with the amine of Formula (3), or mixtures thereof.

Mannich Reaction

In one embodiment the amine-functionalised additive disclosed herein may be a Mannich reaction product obtained/obtainable by reacting the amine having at least 3 aromatic groups (or at least 4 aromatic groups), at least one —$NH_2$ functional group, and at, least 2 secondary or tertiary amino groups where the —$NH_2$ group is condensed with a hydrocarbyl-substituted phenol, (typically an alkylphenol) and an aldehyde in a Mannich reaction to make a covalent attachment of the amine to the hydrocarbyl-substituted phenol. Reactions to form Mannich products are known.

The aldehyde used to form the Mannich product may have 1 to 10, or 1 to 4 carbon atoms, and is generally formaldehyde or a reactive equivalent thereof such as formalin or paraformaldehyde.

The hydrocarbyl substituent of the hydrocarbyl-substituted phenol may have 10 to 400, or 30 to 180, or 40 to 110 carbon atoms. This hydrocarbyl substituent may be derived from an olefin or a polyolefin. Useful olefins include alpha-olefins, such as 1-decene, which are commercially available. Polyolefins suitable for preparing Mannich reaction product of the invention are the same as those are described above. The hydrocarbyl-substituted phenol may be prepared by alkylating phenol with an olefin or polyolefin described above, such as, a polyisobutylene or polypropylene, using well-known alkylation methods. In one embodiment the hydrocarbyl-substituted phenol may be prepared by alkylating phenol with polyisobutylene.

Further Reaction with Polyamines

Reaction of the amine functionalised additive (e.g., aromatic amine functionalised polymer) with additional polyamines having two or more reactive sites may be possible and useful as long as the carboxylic acid functionality is low enough or the polyamine charge is high enough to avoid significant crosslinking of the polymer as evidenced by gellation, incompatibility or poor oil solubility.

Examples of suitable polyamines include ethylenediamine, 1,2-diaminopropane, N-methylethylenediamine, N-tallow($C_{16}$-$C_{18}$)-1,3-propylene-diamine, N-oleyl-1,3-propylenediamine, polyethylenepolyamines (such as diethylenetriamine, triethylenetetramine, tetraethylenepentamine and "polyamine bottoms" (or "alkylenepolyamine bottoms")). In one embodiment the polyamine includes polyalkylenepolyamines. An additive of Formula (1) derived from one of the polyamines is believed to have dispersant properties. And an additive derived from one of the polyamines of Formula (1) is believed to have dispersant properties.

In general, alkylenepolyamine bottoms may be characterised as having less than two, usually less than 1% (by weight) material boiling below about 200° C. A typical sample of such ethylene polyamine bottoms obtained from the Dow Chemical Company of Freeport, Tex. designated "HPA-X™", or from Huntsman as "E-100™". These alkylenepolyamine bottoms may be prepared using an ethylene dichloride process.

Alternatively, capping amines (i.e., monoreactive, monocondensing, non-crosslinking) may be used alone or a combination of capping amines with non-capping polyamines.

Capping Polymer with an Amine

Optionally the amine-functionalised additive may further react with a capping amine, or mixtures thereof. The capping amine may be used to modify the total acid number (herein after referred to as TAN) (typically a reduction in TAN) of the amine-functionalised additive of the invention. The capping amine may if necessary, cap unreacted carboxylic groups in an amount to minimise any detrimental impact on other additives e.g., detergent. The detrimental impact may include an interaction between the amine-containing additive and the detergent, resulting in formation of a gel. In one embodiment the amine-functionalised additive is further reacted with a capping amine. In one embodiment the amine-functionalised additive is not further reacted with a capping amine.

The capping amine may be a monoamine or a polyamine. The capping amine may be an aromatic amine or non-aromatic.

The capping amine may be an amine having two linked aromatic moieties. By the term "aromatic moiety is meant to include both mononuclear and polynuclear groups. The capping amine will typically have an N—H group capable of condensing with the one or more carboxylic groups on the polymer that have not reacted with the amine of the present invention.

The polynuclear groups may be of the fused type wherein an aromatic nucleus is fused at two points to another nucleus such as found in naphthyl or anthranyl groups. The polynuclear group may also be of the linked type wherein at least two nuclei (either mononuclear or polynuclear) are linked through bridging linkages to each other. These bridging linkages may be chosen from, among others known to those skilled in the art, alkylene linkages, ether linkages, ester linkages, keto linkages, sulphide linkages, polysulphide linkages of 2 to 6 sulphur atoms, sulphone linkages, sulphonamide linkages, amide linkages, azo linkages, and direct carbon-carbon linkages between the groups without any intervening atoms. Other aromatic groups include those with heteroatoms, such as pyridine, pyrazine, pyrimidine, and thiophene. Examples of the aromatic groups that are useful herein include the aromatic groups derived from benzene, naphthalene, and anthracene, preferably benzene. Each of these various aromatic groups may also be substituted by various substituents, including hydrocarbyl substituents.

The capping amine may, in general, contain one or more reactive (condensable) amino groups. A single reactive amino group is sometimes preferred. Multiple amino groups, as in the case of the above described N,N-dimethylphenylenediamines, may be useful as well, especially if they are reacted under relatively mild conditions so as to avoid excessive crosslinking or gellation of the additive.

In one embodiment the capping amine is derived from dye intermediates containing multiple aromatic rings linked by, for example, amide structures. Examples include materials of the general Formula (7):

Formula (7)

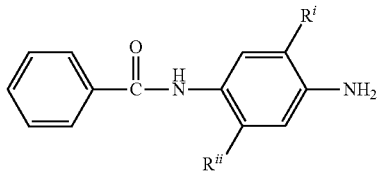

and isomeric variations thereof, where $R^i$ and $R^{ii}$ are independently alkyl or alkoxy groups such as methyl, methoxy, or ethoxy. In one instance, $R^i$ and $R^{ii}$ are both —$OCH_3$ and the material is known as Fast Blue RR [CAS#6268-05-9]. The orientation of the linking amido group may be reversed, to —NR—C(O)—.

In another instance, $R^{ii}$ is —$OCH_3$ and $R^i$ is —$CH_3$, and the material is known as Fast Violet B [99-21-8]. When both $R^i$ and $R^{ii}$ are ethoxy, the material is Fast Blue BB [120-00-3]. U.S. Pat. No. 5,744,429 discloses other capping amine compounds, particularly aminoalkylphenothiazines. N-aromatic substituted acid amide compounds, such as those disclosed in U.S. Patent Application 2003/0030033 A1, may also be used for the purposes of this invention. Suitable capping amines include those in which the amine nitrogen is a substituent on an aromatic carbocyclic compound, that is, the nitrogen is not $sp^2$ hybridised within an aromatic ring.

In one embodiment the capping amine may be an amine having two aromatic moieties linked by an —O— group. An example of such an amine is phenoxyphenylamine, also known as phenoxyaniline or aminophenyl phenyl ether, which may be represented by Formula (8):

Formula (8)

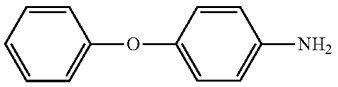

and its various positional isomers (4-phenoxy, 3-phenoxy, and 2-phenoxyaniline). Either or both of the aromatic groups may bear substituents, including hydrocarbyl, tertiary amino, halo, sulphoxy, hydroxy, nitro, carboxy, and alkoxy substituents. The amine nitrogen may be a primary amine nitrogen, as shown, or it may be secondary, that is, bearing a further substituent such as hydrocarbyl, preferably short chain alkyl such as methyl. In one embodiment, the capping amine is the unsubstituted material shown above.

The capping amine may be an amine having two aromatic moieties linked by an —N═N— group, an azo group. Such a material may be represented by Formula (9):

Formula (9)

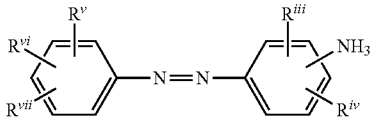

wherein each R group are hydrogen or substituents as described above for the phenoxyphenylamine. Thus, each or $R^{iii}$ and $R^{iv}$ may be independently be H, —$NH_2$, hydrocarbyl or alkyl such as —$CH_3$, halo such as —Cl, sulphoxy such as —$SO_3H$, or —$SO_3Na$; and each of $R^v$, $R^{vi}$, and $R^{vi}$ is independently H, —OH, —$NO_2$, —$SO_3H$, carboxy such as —$CO_2Na$, or alkoxy such as —$OC_4H_9$. These materials are described in greater detail in U.S. Pat. No. 5,409,623, see column 4.

In one embodiment the azo-linked capping amine may be represented by Formula (10):

Formula (10)

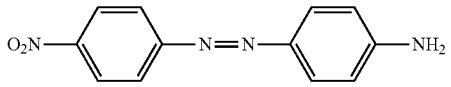

that is, 4-(4-nitrophenylazo)aniline, as well as positional isomers thereof. The material shown is commercially available as a dye known as Disperse Orange 3.

In one embodiment capping amine may be an amine having two aromatic moieties linked by a —C(O)O— group. Each group may be substituted as described above for the oxygen-linked and the azo-linked amines. In one embodiment this amine may be represented by Formula (11):

Formula (11)

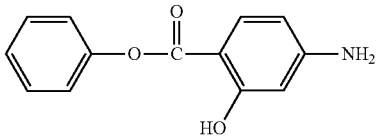

as well as positional isomers thereof. The material shown is phenyl-4-amino salicylate or 4-amino-2-hydroxy benzoic acid phenyl ester, which is commercially available.

In one embodiment the capping amine may be a diamine represented by the N,N-dialkylphenylenediamine Formula (12):

Formula (12)

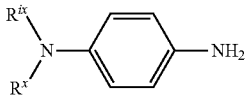

wherein $R^{ix}$ and $R^{x}$ may independently be hydrogen or a hydrocarbyl group (typically containing 1 to 6 carbon atoms).

An example of a particularly useful compound defines both $R^{ix}$ and $R^{x}$ as methyl (N,N-dimethyl-1,4-phenylenediamine).

In one embodiment the capping amine may be an amine having two aromatic moieties linked by an —$SO_2$— group. Each of the aromatic moieties may be substituted as described above for the oxygen-linked and the azo-linked amines. In one embodiment the linkage, in addition to —$SO_2$—, further contains an —NR— or specifically an —NH— group, so that the entire linkage is —$SO_2$NR— or —$SO_2$NH—. In one embodiment, this capping amine may be represented by Formula (13):

Formula (13)

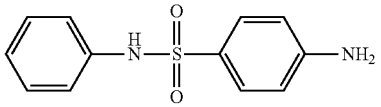

The structure as shown is that of 4-amino-N-phenyl-benzenesulphonamide. A commercially available variation thereof is sulphamethazine, or N'-(4,6-dimethyl-2-pyrimidinyl)sulphanilamide (CAS Number 57-68-1) which is believed to be represented by Formula (14):

Formula (14)

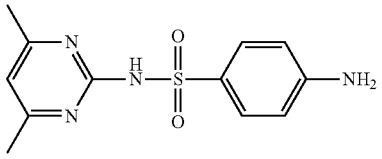

Sulphamethazine is commercially available.

The capping amine may be a nitro-substituted aniline, which can, likewise, bear the substituents as described above for the oxygen-linked and the azo-linked amines. Included are the ortho-, meta-, and para-substituted isomers of nitro aniline. In one embodiment the amine is 3-nitro-aniline.

Examples of other suitable capping amines include amino-substituted aromatic compounds and amines in which the amine nitrogen is a part of an aromatic ring, such as 3-aminoquinoline, 5-aminoquinoline, and 8-amino-quinoline. Also included are capping amines such as 2-aminobenzimidazole, which contains one secondary amino group attached directly to the aromatic ring and a primary amino group attached to the imidazole ring. Other amines include N-(4-anilinophenyl)-3-aminobutanamide or 3-amino propyl imidazole, or 2,5-dimethoxybenzylamine.

The capping amine may also be an aminoquinoline. Commercially available materials include 3-aminoquinoline, 5-aminoquinoline, 6-amino-quinoline, and 8-aminoquinoline and homologues such as 4-aminoquinaldine.

The capping amine may also be an aminobenzimidazole such as 2-aminobenzimidazole.

The capping amine may also be a ring-substituted benzylamine, with various substituents as described above. One such benzyl amine is 2,5-dimethyoxybenzylamine.

Examples of particularly useful capping amines include aniline, N-alkylanilines such as N-methylaniline and N-butylaniline, di-(para-methylphenyl)amine, 4-aminodiphenylamine, N,N-dimethylphenylenediamine, naphthylamine, 4-(4-nitrophenylazo)aniline (disperse orange 3), sulphamethazine, 4-phenoxyaniline, 3-nitroaniline, 4-aminoacetanilide (N-(4-amino-phenyl)acetamide)), 4-amino-2-hydroxy-benzoic acid phenyl ester (phenyl amino salicylate), N-(4-aminophenyl)-benzamide, various benzylamines such as 2,5-dimethoxybenzylamine, 4-phenylazoaniline, and substituted versions of these. Other examples include para-ethoxyaniline, para-dodecylaniline, cyclohexyl-substituted naphthylamine, and thienyl-substituted aniline.

Additional capping amines and related compounds are disclosed in U.S. Pat. Nos. 6,107,257 and 6,107,258; some of these include aminocarbazoles, benzoimidazoles, aminoindoles, aminopyrroles, amino-indazolinones, mercapto-triazoles, aminophenothiazines, aminopyridines, aminopyrazines, amino-pyrimidines, pyridines, pyrazines, pyrimidines, aminothiadiazoles, aminothio-thiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl) amino}butanamide.

In one embodiment the capping amine may be useful as an antioxidant. Of particular importance in that regard are alkylated diphenylamines such as nonyldiphenylamine and dinonyldiphenylamine. To the extent that these materials will condense with the carboxylic functionality of the polymer chain, they are also suitable for use within the present invention. However, it is believed that the two aromatic groups attached to the amine nitrogen may lead to steric hindrance and reduced reactivity. Thus, suitable amines include those having a primary nitrogen atom (—$NH_2$) or a secondary nitrogen atom in which one of the hydrocarbyl substituents is a relatively short chain alkyl group, e.g., methyl. Among such capping amines are 4-phenylazoaniline, 4-aminodiphenylamine, 2-aminobenzimidazole, and N,N-dimethylphenylenediamine. Some of these and other capping amines may also impart antioxidant performance to the polymers, in addition to dispersancy and other properties.

The above-described capping amines may be used alone or in combination with each other. They can also be used in combination with additional, aromatic or non-aromatic, e.g., aliphatic, amines, which, in one embodiment, have 1 to 8 carbon atoms. Other capping amines can include such amines as aminodiphenylamine. These additional amines may be included for a variety of reasons. Sometimes it may be desirable to incorporate an aliphatic amine in order to assure complete reaction of the acid functionality of the polymer, in the event that some residual acid functionality may tend to react incompletely with the relatively more bulky capping amine. Alternatively, the aliphatic amine may replace a portion of a more costly aromatic amine, while maintaining the majority of the performance of the capped additive. Aliphatic monoamines include methylamine, ethylamine, propylamine and various higher amines. Diamines or polyamines may be used for this function i.e., capping, provided that, in general, they have only a single reactive amino group, that is, a primary or secondary group; and typically a primary group. Suitable examples of diamines include dimethylaminopropylamine, diethylaminopropylamine, dibutylaminopropylamine, dimethylaminoethylamine, diethylaminoethylamine, dibutylamino ethylamine, 1-(2-aminoethyl)piperidine, 1-(2-aminoethyl)-pyrrolidone, aminoethylmorpholine, and aminopropylmorpholine. The amount of such an amine is typically a minor amount compared with the amount of the capping amine, that is, less than 50% of the total amine present on a weight or molar basis, although higher amounts may be used, such as 70 to 100%. Exemplary amounts include 10 to 70 weight percent, or 15 to 50 weight percent, or 20 to 40 weight percent. Use of certain combinations of 4-phenoxyaniline with dimethylaminopropylamine within these ranges, for instance, provides particularly good performance in terms of soot suspension. In certain embodiments, the polymers may be functionalised with three or more different amines, for instance, with 3-nitroaniline, 4-(4-nitrophenylazo)aniline, and dimethylaminopropylamine.

In one embodiment the capping amine may be selected from the group consisting of aniline, 4-aminodiphenylamine, benzylamine, phenethylamine, 3,4-dimethoxyphenethylamine, 1,4-dimethylphenylenediamine, and mixtures thereof.

In one embodiment the capping amine may be selected from the group consisting of aniline, 4-aminodiphenylamine, 1,4-dimethylphenylenediamine, and mixtures thereof.

The capping amine may be reacted with the amine having at least 3 aromatic groups by a process comprising: reacting (i) a product obtained/obtainable by reacting a carboxylic functionalised polymer with an amine having at least 3 aromatic groups, at least one —$NH_2$ functional group, and at least 2 secondary or tertiary amino groups, with (ii) a capping amine as disclosed herein above.

The process may be carried out at a reaction temperature in the range of 40° C. to 180° C., or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, or mixtures thereof.

The reaction may be preformed in either air or an inert atmosphere. Examples of suitable inert atmosphere include nitrogen or argon, typically nitrogen.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, poly-propylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content>0.03 wt %, and/or <90 wt % saturates, viscosity index 80-120); Group II (sulphur content≤0.03 wt %, and ≥90 wt % saturates, viscosity index 80-120); Group III (sulphur content≤0.03 wt %, and ≥90 wt % saturates, viscosity index≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of the additive as described herein above, and the other performance additives.

The lubricating composition may be in the form of a concentrate and/or a fully formulated lubricant. If the lubricating composition of the invention is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives comprise at least one of metal deactivators, viscosity modifiers, detergents, friction modifiers, antiwear agents, corrosion inhibitors, dispersants (other than the amine functionalised additive of present invention as described above), dispersant viscosity modifiers (other than the amine functionalised additive of present invention as described above), extreme pressure agents, antioxidants, foam inhibitors, demulsifiers, pour point depressants, seal swelling agents and mixtures thereof. Typically, fully-formulated lubricating oil will contain one or more of these performance additives.

INDUSTRIAL APPLICATION

The additive of the invention may be added to a lubricant in a range of 0.01 wt % to 20 wt %, or 0.05 wt % to 10 wt %, or 0.08 wt % to 5 wt %, or 0.1 wt % to 3 wt % of the lubricating composition.

The lubricating composition may be utilised in an internal combustion engine. The internal combustion engine may or may not have an Exhaust Gas Recirculation system.

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, or 325 ppm to 700 ppm. The total sulphated ash content may be 2 wt % or less, or 1.5 wt % or less, or 1.1 wt % or less, or 1 wt % or less, or 0.8 wt % or less, or 0.5 wt % or less. In one embodiment the sulphated ash content may be 0.05 wt % to 0.9 wt %, or 0.1 wt % to 0.2 wt % to 0.45 wt %.

In one embodiment the lubricating composition is an engine oil, wherein the lubricating composition is characterised as having at least one of (i) a sulphur content of 0.5 wt % or less, (ii) a phosphorus content of 0.1 wt % or less, and (iii) a sulphated ash content of 1.5 wt % or less.

In one embodiment the lubricating composition is suitable for a 2-stroke or a 4-stroke marine diesel internal combustion engine. In one embodiment the marine diesel combustion engine is a 2-stroke engine. The ashless antiwear agent of the invention may be added to a marine diesel lubricating composition at 0.01 to 20 wt %, or 0.05 to 10 wt %, or 0.1 to 5 wt %.

The following examples provide illustrations of the invention. These examples are non-exhaustive and are not intended to limit the scope of the invention.

EXAMPLES

Preparative Example 1 (EX1) is a polymer head group synthesis. 500 mL of 2M hydrochloric acid is added to a one-litre 4-neck flask equipped with an overhead stirrer, thermowell, addition funnel with nitrogen line, and condenser. 184.2 g of 4-aminodiphenylamine is added, and the flask is heated to 75° C. The addition funnel is then charged with 40.5 g of a 37% formaldehyde solution and the solution is added drop-wise to the flask over a period of 30 minutes. The flask is maintained at 100° C. for 4 hours. The flask is then cooled to ambient temperature. 80 g of a 50/50 wt/wt solution of sodium hydroxide in water is added over 30 minutes. At the end of the reaction, a solid product is obtained via filtration. The resultant solid product is believed to primarily be the compound of Formula (2) as described above. In addition, the resultant product may contain a small percentage of product based on Formula (3) as described above.

Preparative Example 2 (EX2) is a reaction product of polyisobutylene succinic anhydride with the product of EX1. A three-litre, 4-neck flask equipped with an overhead stirrer, thermowell, subsurface inlet with nitrogen line, and Dean-Stark trap with condenser is charged with polyisobutylene succinic anhydride (1270.0 g) (where the polyisobutylene has a number average molecular weight of 2000) and diluent oil (1400.1 g). The flask is heated to 90° C. The product of EX1 (442.0 g) is added slowly. The temperature is then raised to 110° C. and held until the water from the product of EX1 is removed. The temperature is then raised to 160° C. and held for 10 hours. To the flask is added a portion of a diatomaceous earth filter aid, and then flask contents are filtered through a second portion of the diatomaceous earth filter aid. The resultant product is a dark oil with a nitrogen content of 0.65 wt %.

Preparative Example 3 (EX3) is a reaction product of a maleinated ethylene-propylene copolymer with the product of EX1. A two-litre, 4-neck flask equipped with an overhead stirrer, thermowell, subsurface inlet with nitrogen line, and Dean-Stark trap with condenser is charged with a maleinated ethylene-propylene copolymer (where the ethylene-propylene copolymer has a number average molecular weight of 8000, and 3.3 wt % of maleic anhydride is grafted on to the ethylene-propylene copolymer) diluted in oil (75:25 wt %) (350.0 g) and diluent oil (906.8 g). The flask is heated to 110° C. The product of EX1 (19.8 g) is added slowly. The temperature is then raised to 160° C. and held for 6 hours. To the flask is added a portion of a diatomaceous earth filter aid, and then flask contents are filtered through a second portion of the diatomaceous earth filter aid. The resultant product is a dark oil with a nitrogen content of 0.17 wt %.

Preparative Example 4 (EX4) is a reaction product of methylenedianiline and nitrobenzene. A 500-ml three-necked round bottom flask with an overhead stirrer is charged with methylenedianiline (213 g, 1.08 mol) and heated to 100° C. Nitrobenzene (4.3 ml, 42 mmol) is then charged to the flask. To the stirred reaction mixture is added tetramethylammonium hydroxide dihydrate (17.7 g, 140 mmol) as a solid. The reaction is allowed to stir for 18 hours. Water (16 mL) is added to the mixture and the reaction is charged to an autoclave for hydrogenation. A 1% Pt/C catalyst (0.5 g dry weight) is added and the mixture heated to 100° C. under 1.034 MPa (equivalent to 150 psig) of hydrogen for 30 minutes.

Preparative Example 5 (EX5) is a reaction product of methylenedianiline and nitrobenzene. A 25 mL round bottom flask is charged with dimethyl sulphoxide (DMSO) (4 mL), methylenedianiline (208 mg, 1.05 mmol), nitrobenzene (200 mL, 1.9 mmol) and tetramethylammonium hydroxide dihydrate (330 mg, 2.5 mmol) under argon. The reaction is allowed to proceed at room temperature for 4 hours. The reaction is charged to an autoclave for hydrogenation. A 1% Pt/C catalyst (0.5 g dry weight) is added and the mixture heated to 100° C. under 1.034 MPa (equivalent to 150 psig) of hydrogen for 30 minutes.

Comparative Example 2 (COMP2) is a reaction product of polyisobutylene succinic anhydride with aminodiphenylamine. A one-litre, 4-neck flask equipped with an overhead stirrer, thermowell, subsurface inlet with nitrogen line, and Dean-Stark trap with condenser is charged with polyisobutylene succinic anhydride (300.0 g) (where the polyisobutylene has a number average molecular weight of 2000) and diluent oil (329.4 g). The flask is heated to 110° C. Aminodiphenylamine (32.6 g) is added supra-surface. The temperature is then raised to 160° C. and held for 10 hours. To the flask is added a portion of a diatomaceous earth filter aid, and then flask contents are filtered through a second portion of the diatomaceous earth filter aid. The resultant product is a dark oil with a nitrogen content of 0.74 wt %.

Rheology Test

A series of samples prepared above are evaluated in a drain oil rheology test. The samples are based on engine oil lubricants with low sulphur, phosphorus and ash content. The samples contain an amount of product from the preparative examples described above. The samples are analysed using the oscillation rheology test with a TA Instruments AR500™ rheometer in oscillation mode. The test geometry is a 40 mm flat top plate, and the sample is placed directly onto the flat variable temperature peltier plate of the rheometer. The samples are pre-sheared for 30 seconds at a shear stress of 0.080 Pa to ensure that all samples have a similar baseline shear history. The samples are allowed to equilibrate for 5 minutes before the oscillation test is initiated. The samples are equilibrated for a further 1 minute between each temperature step. Sample evaluation is performed with a temperature sweep test at a constant strain of 0.06, covering the temperature range of 40° C. to 150° C. with measurements taken at a total of 30 points. G' is the elastic, or storage modulus, and is defined in more detail in The Rheology Handbook, Thomas G. Mezger (edited by Ulrich Zoll), Published by Vincentz, 2002, ISBN 3-87870-745-2, p. 117. Generally, better results are obtained for samples with a lower G' value. The data obtained is shown in table 1. In Table 1, COMP1 is a baseline sooted drain oil, G' ratio is calculated from a ratio of a $G'_{max}$ of each candidate species to that of the equivalent reference oil to provide a normalised measure of reduction in structure build-up.

In each case, the calculation of G' Ratio is made by comparison to a representative sooted drain oil. The sooted drain oil is analysed prior to each sample to allow G' ratio calculation.

The results obtained for the rheology screen test indicate that the additive of the invention reduces soot structure built-up relative to untreated drain oil. Typically better results are obtained for samples where the G' ratio is less than one. The results obtained are:

TABLE 1

| Sample Containing Preparative Example | Treat Rate of Preparative Example (wt % on actives basis) | G' Ratio |
|---|---|---|
| COMP1 | 0 | 1 |
| EX2 | 0.25 | 0.1481 |
| EX2 | 0.50 | 0.0637 |
| EX3 | 0.73 | 0.340 |
| EX3 | 1.45 | 0.117 |

Comparative Study

The results obtained for EX2 are compared with a comparative example (COMP2). The results obtained are:

TABLE 2

| | Treat Rate of Additive (wt % on actives basis) | G' Ratio |
|---|---|---|
| EX2 | 0.148 | 0.0637 |
| COMP2 | 0.784 | 0.522 |

The comparative data demonstrates that the additive of the invention reduces soot structure built-up relative to the comparative example.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of Hydrocarbyl Groups Include:

(i) hydrocarbon substituents, that is, aliphatic (e.g., alkyl or alkenyl), alicyclic (e.g., cyclo alkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms; and (iv) heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and an amine-functionalised additive, wherein the amine-functionalised additive is derived from an amine having at least 4 aromatic groups, at least one —$NH_2$ functional group, and at least 2 secondary or tertiary amino groups, wherein the amine-functionalised additive is a product obtained by reacting the amine having at least 4 aromatic groups, at least one —$NH_2$ functional group, and at least 2 secondary or tertiary amino groups with a carboxylic functionalised polymer, wherein the amine having at least 4 aromatic groups, at least one —$NH_2$ functional group, and at least 2 secondary or tertiary amino groups is represented by the formula:

Formula (1a)

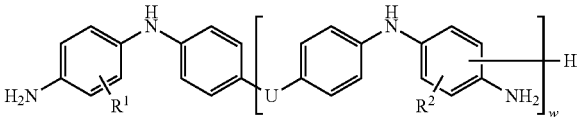

wherein independently each variable, $R^1$ is hydrogen or a $C_{1-5}$ alkyl group;

$R^2$ is hydrogen or a $C_{1-5}$ alkyl group;

U is an aliphatic, alicyclic or aromatic group, with the proviso that when U is aliphatic, the aliphatic group may be linear or branched alkylene group containing 1 to 5-carbon atoms; and w is 1 to 10, and wherein the carboxylic functionalised polymer is a polyisobutylene-succinic anhydride polymer, a maleic anhydride-styrene copolymer, an ester of a maleic anhydride-styrene copolymer, an alpha olefin-maleic anhydride copolymer, or a maleic anhydride graft copolymer of (i) a styrene-ethylene-alpha olefin polymer, (ii) a hydrogenated alkenyl aryl conjugated diene copolymer, (iii) a polyolefin, or (iv) a hydrogenated isoprene polymer, or mixtures thereof.

2. The lubricating composition of claim 1, wherein the carboxylic functionalised polymer is a polyisobutylene succinic anhydride.

3. The lubricating composition of claim 2, wherein the polyisobutylene succinic anhydride is derived from a polyisobutylene with a number average molecular weight of 350 to 5000.

4. The lubricating composition of claim 1, wherein the hydrogenated alkenyl aryl conjugated diene copolymer is a hydrogenated copolymer of styrene-butadiene.

5. The lubricating composition of claim 1, wherein the polyolefin grafted with maleic anhydride is an ethylene-propylene copolymer.

6. The lubricating composition of claim 1, wherein the hydrogenated isoprene polymer is a hydrogenated styrene-isoprene polymer.

7. The lubricating composition of claim 1, wherein the amine-functionalised additive is a product obtained by reacting the amine having at least 3 aromatic groups, at least one —$NH_2$ functional group, and at least 2 secondary or tertiary amino groups with a carboxylic functionalised polymer, forming an imide or amide.

8. A method of lubricating an internal combustion engine comprising supplying to the internal combustion engine the lubricating composition of claim 1.

9. The lubricating composition of claim 1, wherein w is 1 to 4.

10. The lubricating composition of claim 1, wherein w is 1 to 2.

11. The lubricating composition of claim 1, wherein w is 1.

* * * * *